US005100262A

United States Patent [19]

Michael et al.

[11] Patent Number: 5,100,262

[45] Date of Patent: Mar. 31, 1992

[54] EXPANDING BASE DEEP FOUNDATION SYSTEM

[76] Inventors: Richard D. Michael; Hiroshi Sato, both of 834 Emory Ct., Merced, Calif. 95340

[21] Appl. No.: 459,935

[22] Filed: Feb. 23, 1990

[51] Int. Cl.[5] ..... E02D 5/44

[52] U.S. Cl. ..... 405/237; 405/232; 405/231

[58] Field of Search ..... 405/237, 238, 233, 241, 405/239, 231, 232

[56] References Cited

U.S. PATENT DOCUMENTS 1,443,306 1/1923 Blumenthal ..... 405/238
1,951,643 3/1934 Bald ..... 405/233
2,184,514 12/1939 Cleesattel ..... 405/237
2,963,869 12/1960 Cobi ..... 405/237
4,058,175 11/1977 Holland ..... 405/233 X

FOREIGN PATENT DOCUMENTS 0525548 8/1940 United Kingdom ..... 405/237

*Primary Examiner*—Dennis L. Taylor

[57] ABSTRACT

An expanding deep base foundation system including a pre-manufactured base foot attached to the lower end of a metal shaft. The base being a length of pipe having cuts made along the length thereof. Cams are mounted on the inside of the pipe that expand the wall of the pipe foot outwardly as the metal shaft is forced through the expanding base thereby creating an enlarged base or foot.

1 Claim, 12 Drawing Sheets

EXPANDING BASE DEEP FOUNDATION SYSTEM

Reference cited in the filing of the patent

| U.S. Pat. Nos. | | |
|---|---|---|
| 1,443,306 | Blumenthal | Aug. 5, 1919 |
| 1,794,892 | Goldsborough | Mar. 3, 1931 |
| 1,951,643 | Bald | Dec. 12, 1931 |
| 1,900,622 | Tada | Mar. 7, 1933 |
| 1,951,645 | Boosey | Mar. 20, 1934 |
| 2,184,514 | Cleesattel | Sep. 27, 1937 |
| 2,277,758 | Hawkins | Mar. 31, 1942 |
| 2,326,872 | Marsden | Aug. 17, 1943 |
| 2,631,435 | Emshwiller | Mar. 17, 1953 |
| 2,791,900 | Ruben | May. 14, 1957 |
| 4,058,175 | Holland | Jul. 6, 1976 |

FIELD OF THE INVENTION

The invention relates to a method of providing a deep pile foundation that can support more load weight in various soil types, and is faster to construct. The invention consists of a pre-manufactured expanding foot which is attached to a pipe shaft and extended into a prepared hole. The hole is drilled and belled at the bottom using existing methods. The expanding foot is mounted on the pipe shaft and lowered into the hole. At the bottom of the hole the foot is expanded by hammering the pipe shaft. The hammering of the pipe expands the foot and compacts the loose soil at the bottom of the hole. Concrete is pumped onto the pipe shaft from the open top and out the bottom of the pipe shaft at the foot which has been expanded by the hammering. The concrete is forced up the outside of the pipe filling the space between the pipe and the excavation. The amount of concrete needed to accomplish this is determined by substracting the known volume of the pipe shaft from the known volume of the excavated hole. When this has been accomplished the results is an expanded foot and pipe shaft incased in concrete leaving the pipe shaft hollow.

DESCRIPTION OF THE INVENTION

Figure 1:
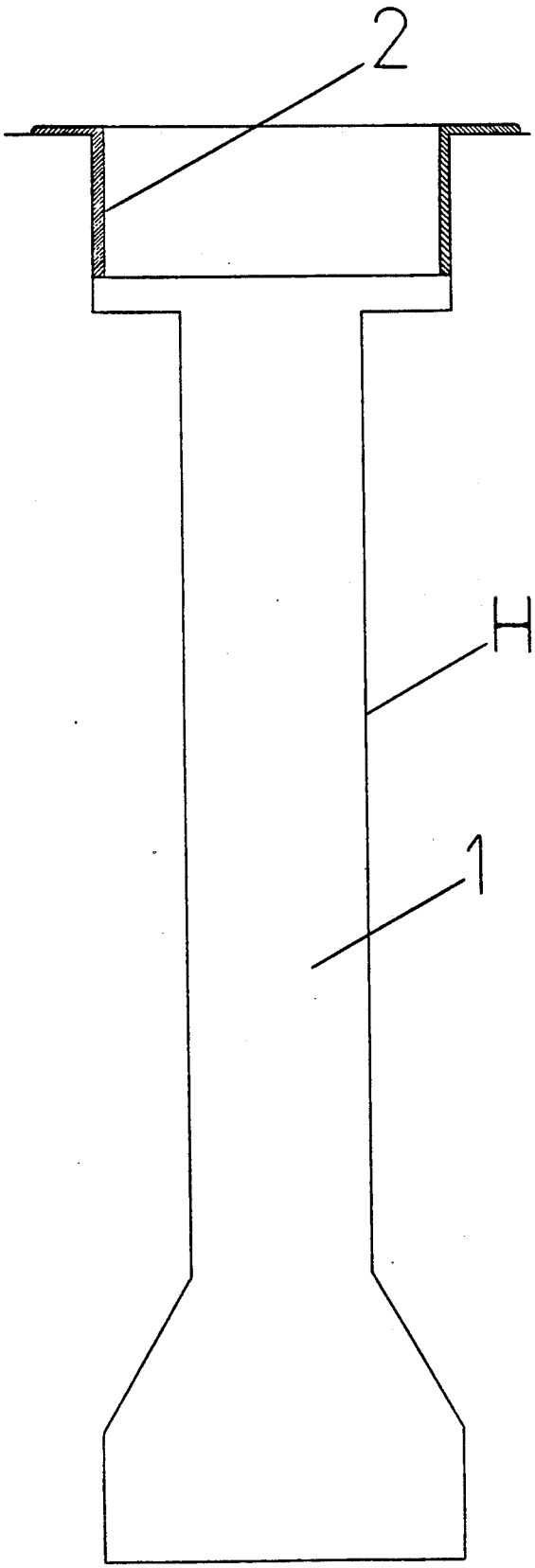
FIG. 1 shows a bell bottom hole.

FIG. 1 shows a typical bell bottom hole labeled (H) which has been prepared using the standard industrial techniques. At the top of the hole a slightly larger diameter hole is excavated. An outer casing of steel or other suitable material (2) is then lowered into position in the hole. This outer casing provides protection to the top of the excavated hole, and a working surface for men and equipment. The hole is then filled with a solution of water-bentonite (1) which is common practice within the industry.

Figure 2:
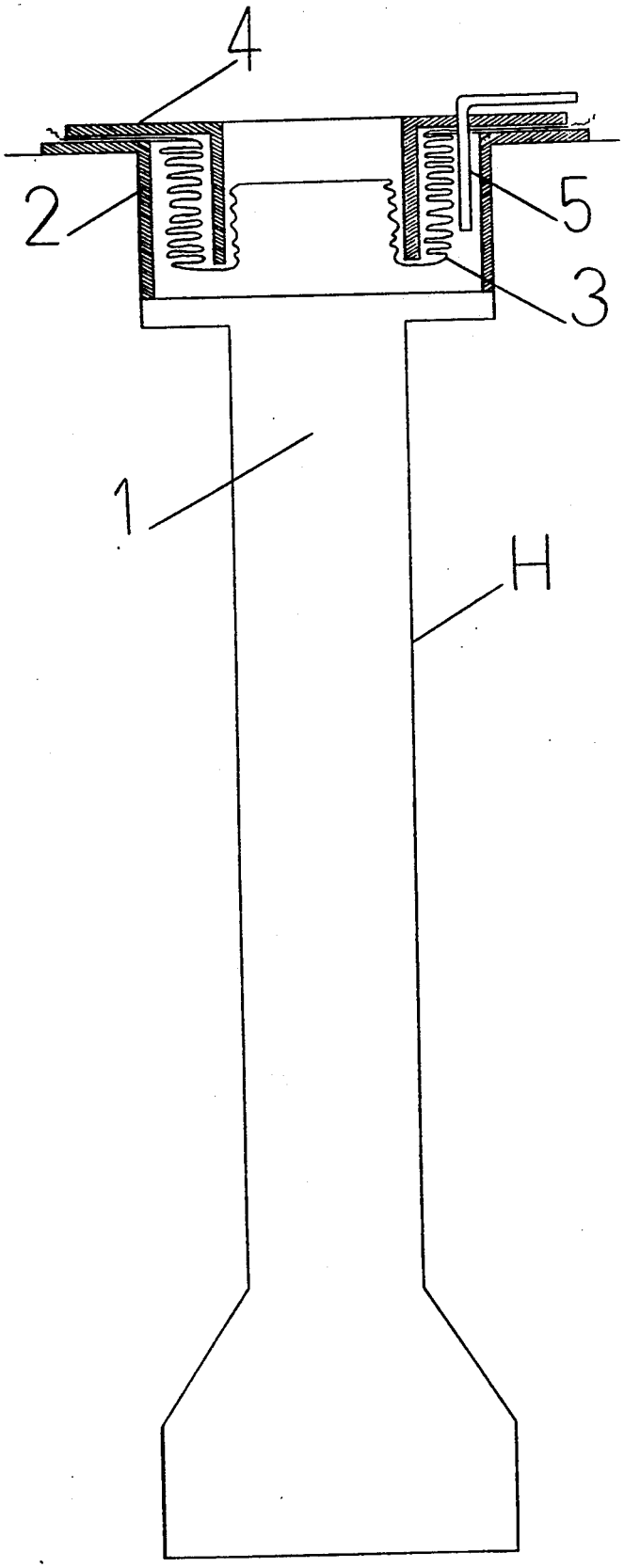
FIG. 2 shows a plastic baggie secured at the top of the hole of FIG. 1.

FIG. 2 shows a plastic baggie (3) which is sealed at one end and is the length of the hole's depth. The baggie is fashioned so that it may extend down the length of the hole with the sealed end at the bottom of the hole. The open end of the baggie is placed in such a fashion so that when the inner casing is fitted over the outer casing, the top of the baggie is wedged between the inner and outer casings. The purpose of the baggie is to prevent the loose soil and water-bentonite mixture from contaminating the concrete. In addition, the baggie helps to reduce the shear loading on the pile caused by the friction of the downward force of the soil around the pile as the soil settles. A water pump means (5) is then fitted into position through the inner casing and baggie such that the water pick-up means is exposed to the water-bentonite solution in the hole.

Figure 3:
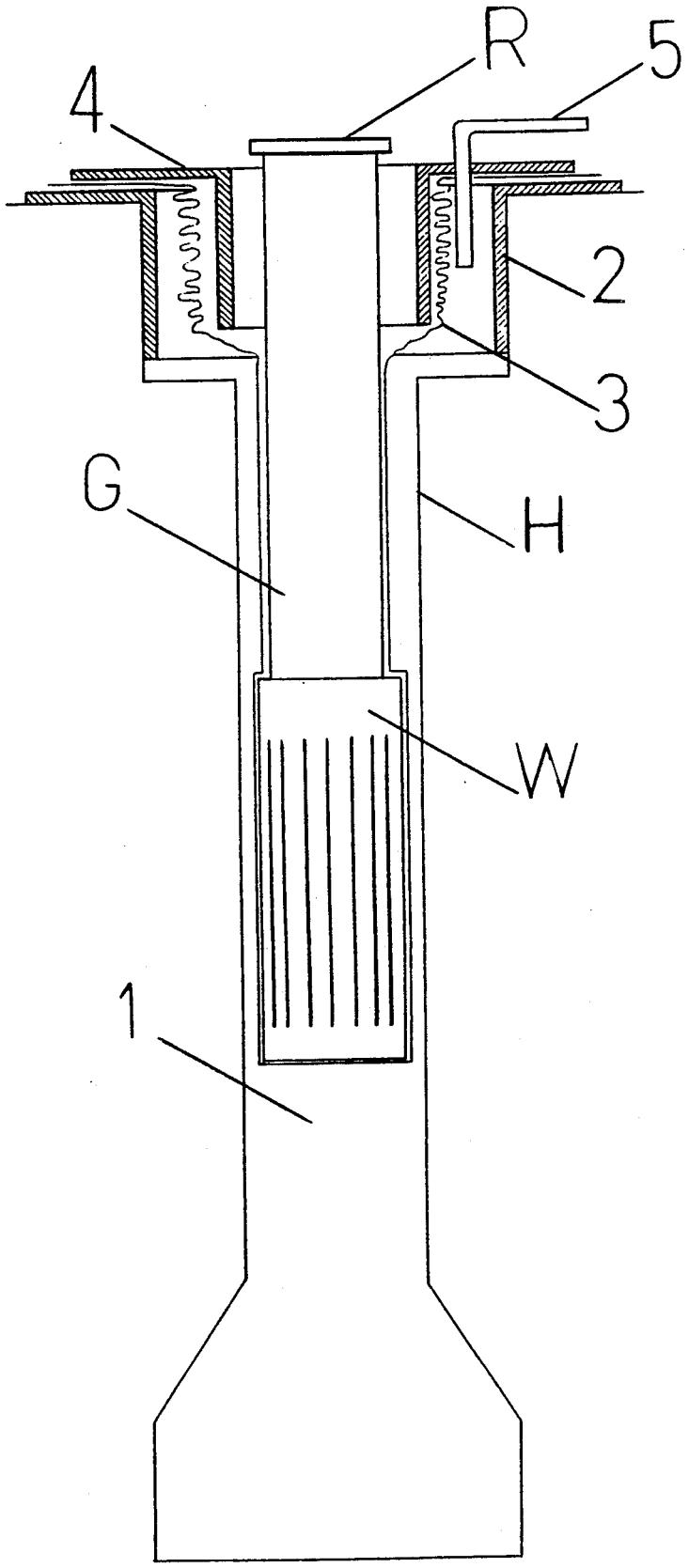
FIG. 3 shows the expanding foot system located in the bell bottom hole of FIG. 1.

FIG. 3 shows the expanding foot system (w) is fitted to section (G) and the system is lowered through the access hole at the top of the inner casing. As the system is lowered into the hole, the baggie is drawn down into the hole. The water which is displaced by the system as the system is lowered into the hole is drawn off by the water pump means. This water may be stored in a storage tank for later use.

Figure 4:
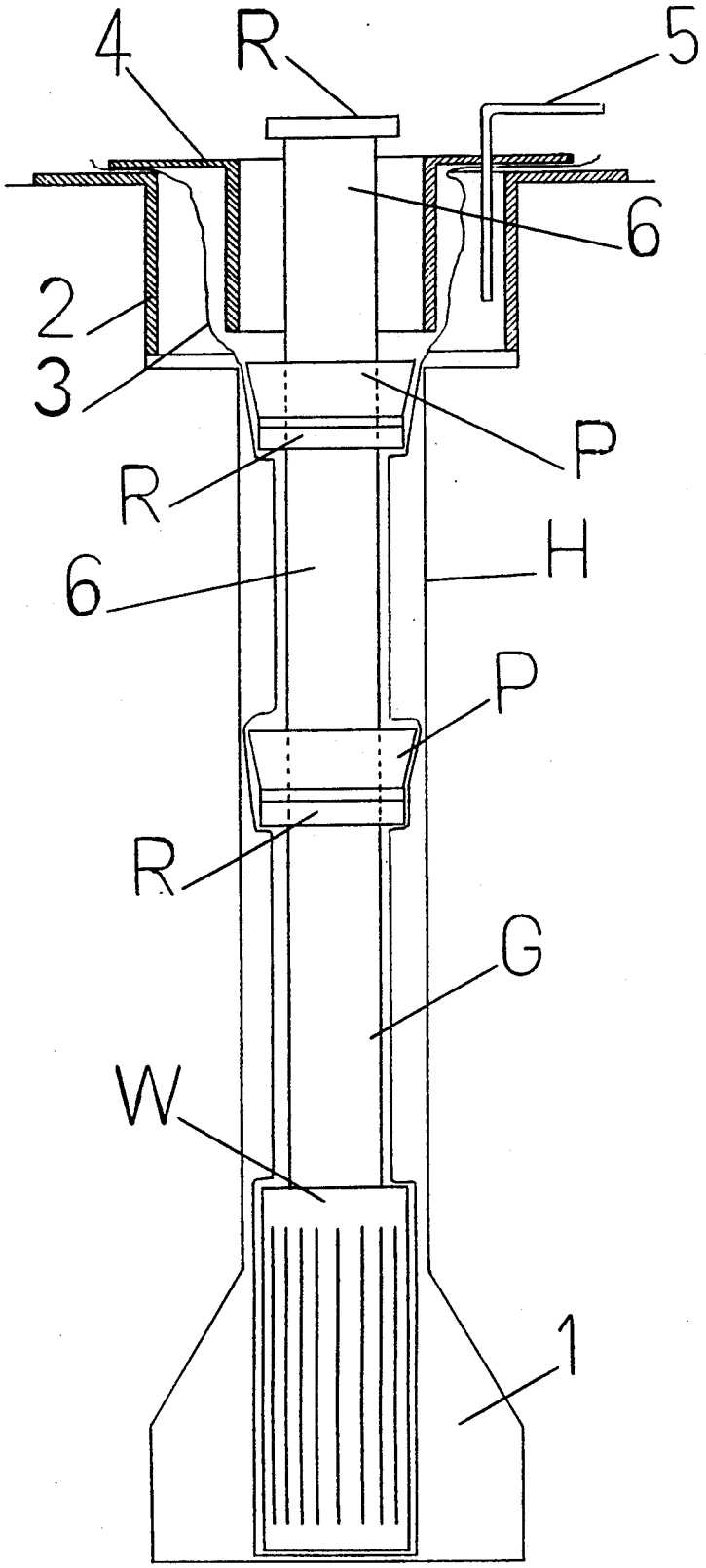
FIG. 4 shows additional sections of pipe secured to the expanding foot system.

FIG. 4 shows additional sections of pipe (6) are added to the system as required until the system is fully lowered into the hole and the expanding foot is at the bottom of the hole. During the lowering of the system, the amount of concrete (7) which is necessary to fill the belled area and form a layer between the outside of the pipe shaft and the wall of the excavated hole is poured into the pipe shaft. On each section of pipe (6) which is added, a slip ring seal (P) made of rubber is placed such that the pipe joint (R) acts as a stop at the base of the slip ring seal preventing the seal from moving down the pipe. This seal is designed so it will allow the movement of material up the side of the pipe between the pipe and excavation, but resists movement down the outside of the pipe.

Figure 5:
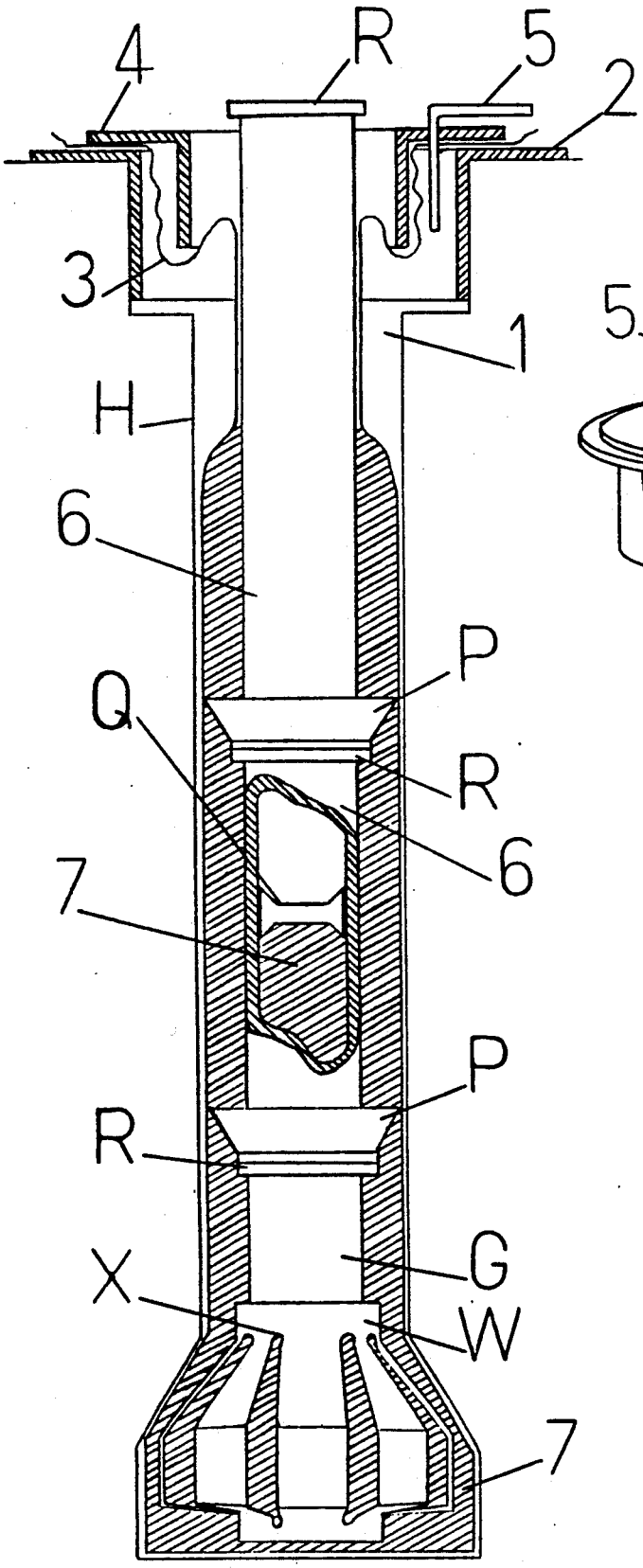
FIG. 5 shows the foot system in an expanded condition.
Figure 5A:
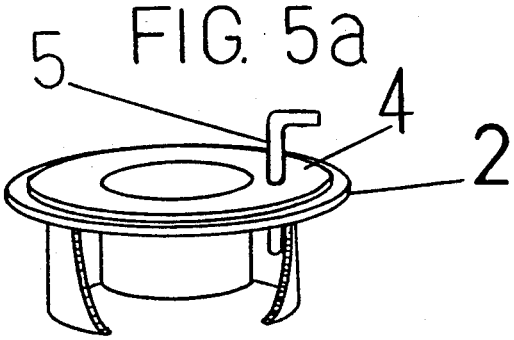
Figure 7:
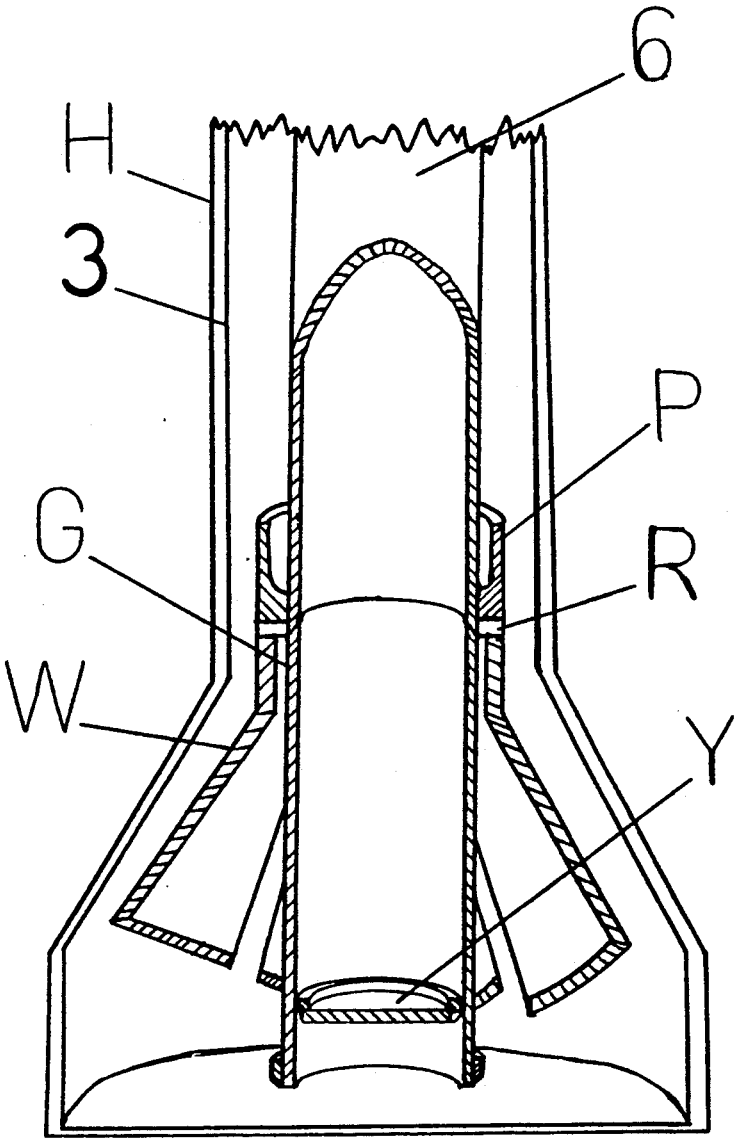
FIGS. 7 and 8 show various stages of the pumping action of the system.
Figure 8:
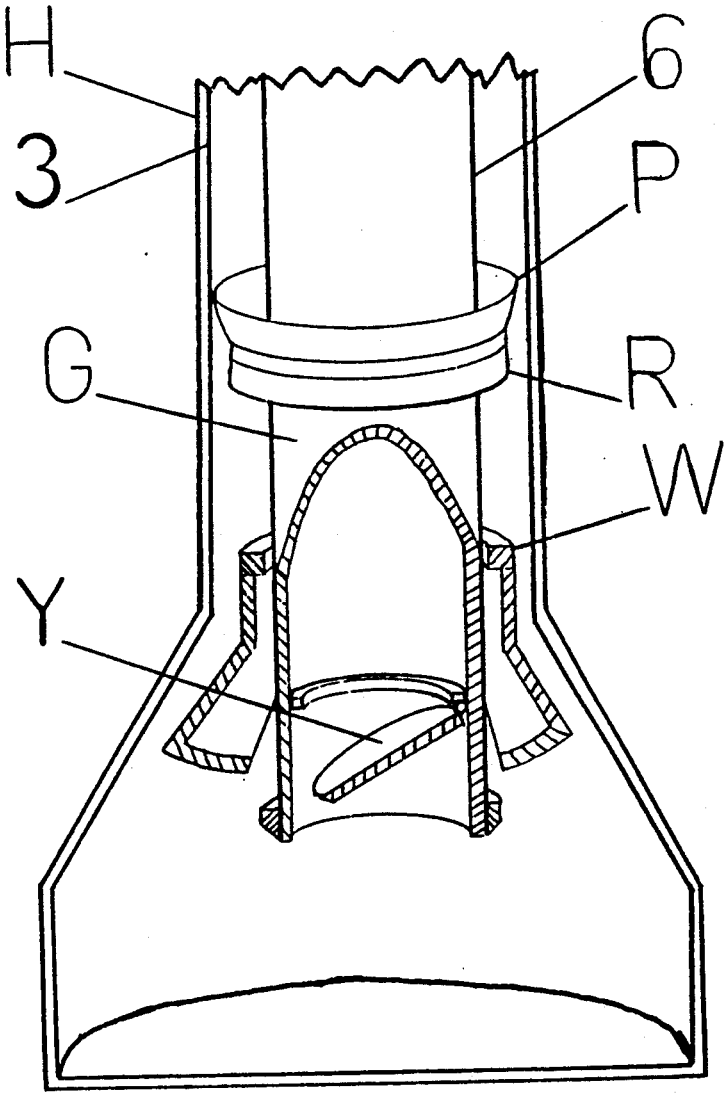

FIG. 5—Once the system is at the bottom of the hole and the necessary amount of concrete has been poured into the pipe shaft, the pipe is hammered which forces the pipe shaft into the expanding foot, expanding the foot at the bottom of the hole. Concrete (7) is pumped down the pipe and out the bottom of the expanding foot system by means of a flapper valve (Y) located in section (G), and a plug (Q) which is forced down the pipe when the necessary amount of concrete has been poured into the pipe. The pumping action is accomplished by raising and lowering the pipe. This action is illustrated in FIG. 7 and FIG. 8. As the system is raised (FIG. 8) the concrete in the pipe, being aided by pressure from the plug, travels down the pipe. The plug can be forced down the pipe be means of water or air pressure or any other such means. At the bottom of section (G) a typical flapper valve is located in such a way that when the pipe is raised, the concrete tries to flow down the center of the pipe. The flapper valve gives in this direction and allows the concrete to flow down and out the bottom of the pipe. Additionally while the pipe is being raised, the slip ring seals located on the outside of the pipe, which are designed to expand and resist movement in a relative down direction expand and assist in pushing the concrete up along the outside of the pipe. When the pipe is lowered as in FIG. 7, the flapper valve located in section (G) reacts to the back pressure of the concrete and it closes. This forces the concrete located below the flapper valve out of the expanding foot system, and up along the outside of the pipe. The slip ring seals respond to the relative up movement of the concrete and collapse allowing the concrete movement in this direction.

Figure 6:
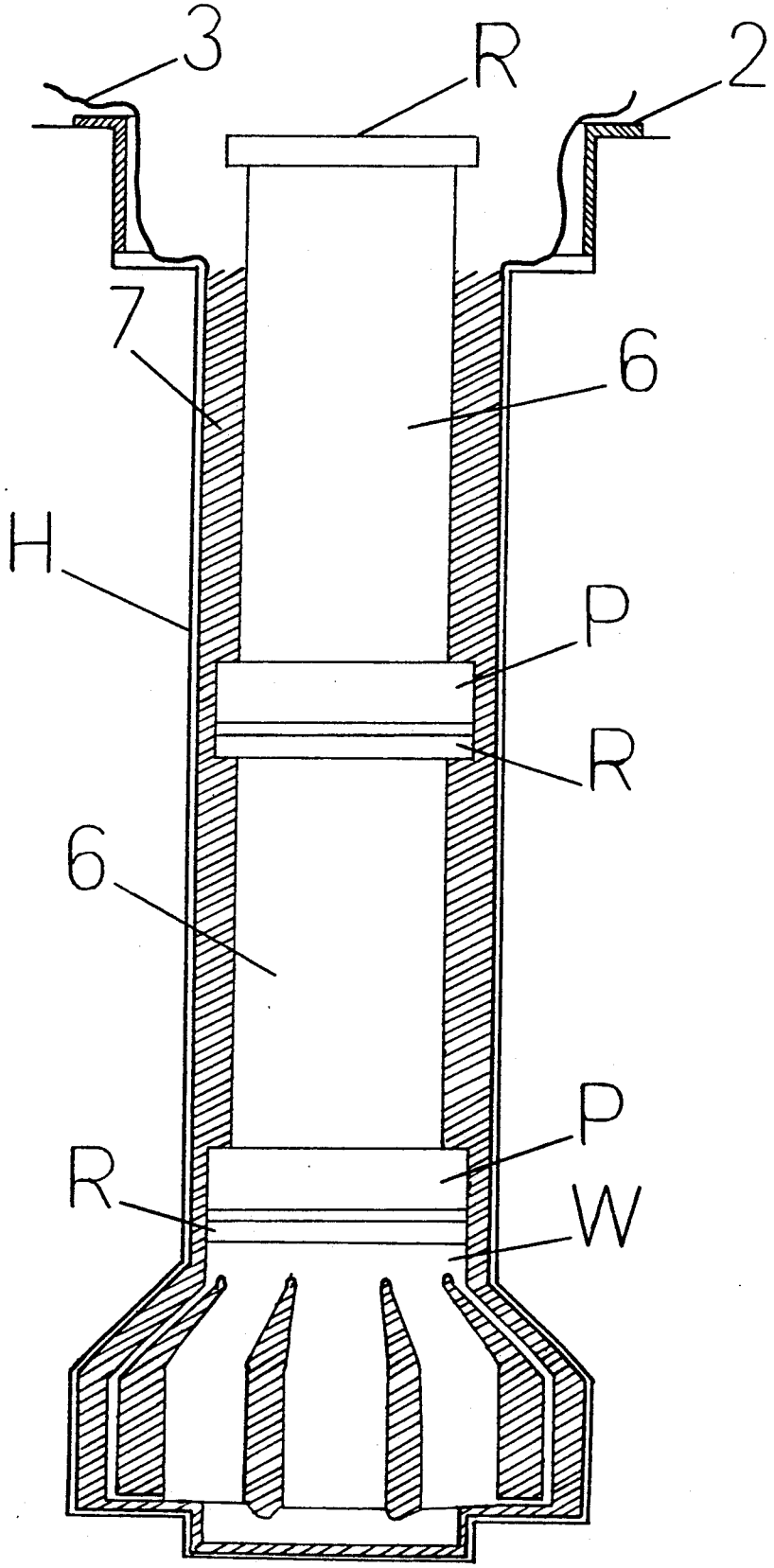
FIG. 6 shows the expanding foot system hammered in place.

FIG. 6 shows what the system looks like once this pumping action is complete and the system has again been hammered until it is fully expanded and the expanded foot is driven into the bottom of the hole. This reduces the chance of later settling of the pile.

Figure 9:
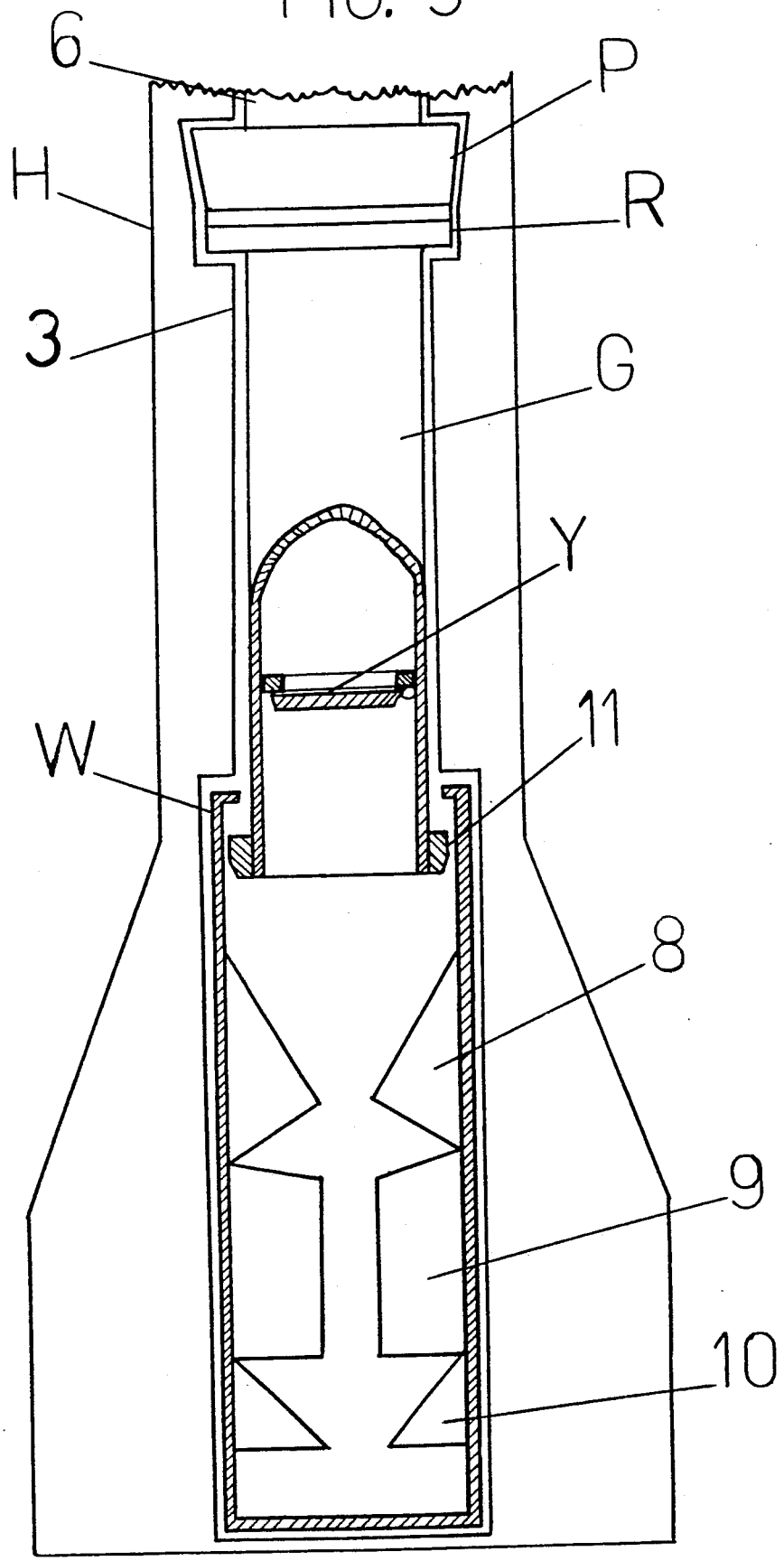
FIG. 9 shows two main sections of the expanding foot system.

FIG. 9 show the expanding foot system is comprised of two main sections. Section (G) which is a pipe whose size is determined by the depth and support load requirements, and the expanding foot (W). Section (G) is fitted with a flapper valve near the bottom of the pipe and the flapper valve is installed such that is will allow the movement of material in the direction of the expanding foot (down) but not allow movement in the other direction (up). The top end of section (G) is fitted with a joint which will allow an additional section of pipe to be added. A slip ring (12) made of a section of steel is cut so that the section (G) can be passed through the center of the ring, and the out side diameter of the ring is the same as the outside diameter of the expanding foot. Section (G) is passed through the center of the slip ring, and a stop (11) is welded to the bottom of section (G). The stop (11) is designed so that once welded to the bottom of section (G) it will prevent the slip ring (12) from coming off of section (G) while allowing the stop to pass through the center of the expanding foot (W).

The slip ring is welded to the top of the expanding foot (W) which will allow section (G) to pass down through the expanding foot, but it will not come out when pulled.

Figure 10:
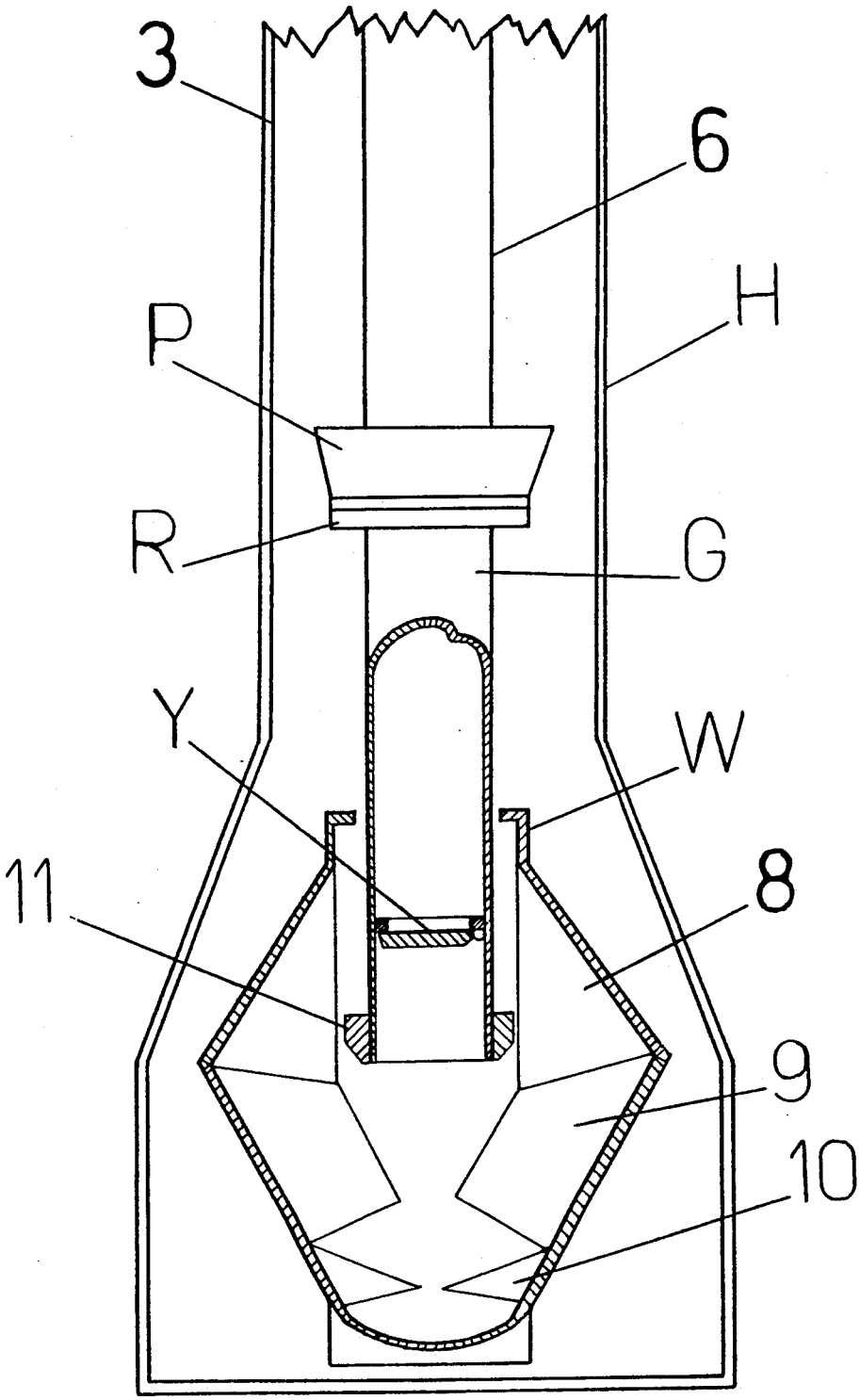
FIG. 10 shows the stop of the expanding foot system contacting cams which expand the foot into a bell shape.

FIG. 10 shows when section (G) is hammered down through the expanding foot (W) the stop (11) contacts the cams (8), (9), and (10) which expand the foot into the bell shape.

Figure 11:
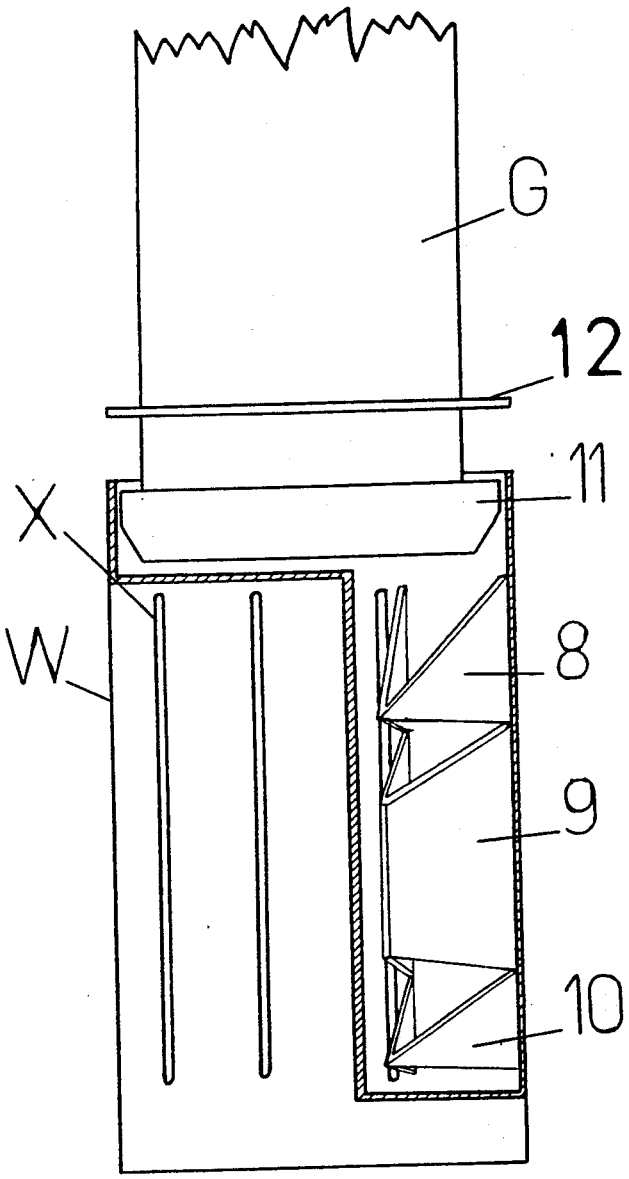
FIG. 11 shows the expanding footing and the lower end of the section of pipe.
Figure 11A:
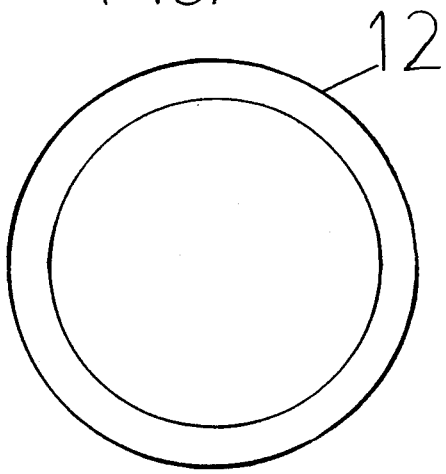

FIG. 11; The expanding foot (W) is a pipe which is larger in diameter than section (G) and has cuts (X) running along the length of the pipe. The amount of cuts and their distance apart may very depending on the diameter of the pipe, and the specific need of the expanding foot. The cuts usually start a short distance from the top of the foot. The cuts must be of a uniform distance apart, and for each two cuts in the foot, one bending section is created. The amount of bending sections needed for each application may very depending on the diameter of the foot. On the inside of each bending section three cams (8), (9), and (10) are welded to the section of the expanding foot between the cuts. These cams may be made as depicted or in any other fashion so that when section (G) is passed down through the expanding foot the action of the cams forces the bending section to bend as illustrated in FIG. 10. The bottom of section (W) is then sealed with a metal plate which is cut to dimension and welded into place.

Figure 12:
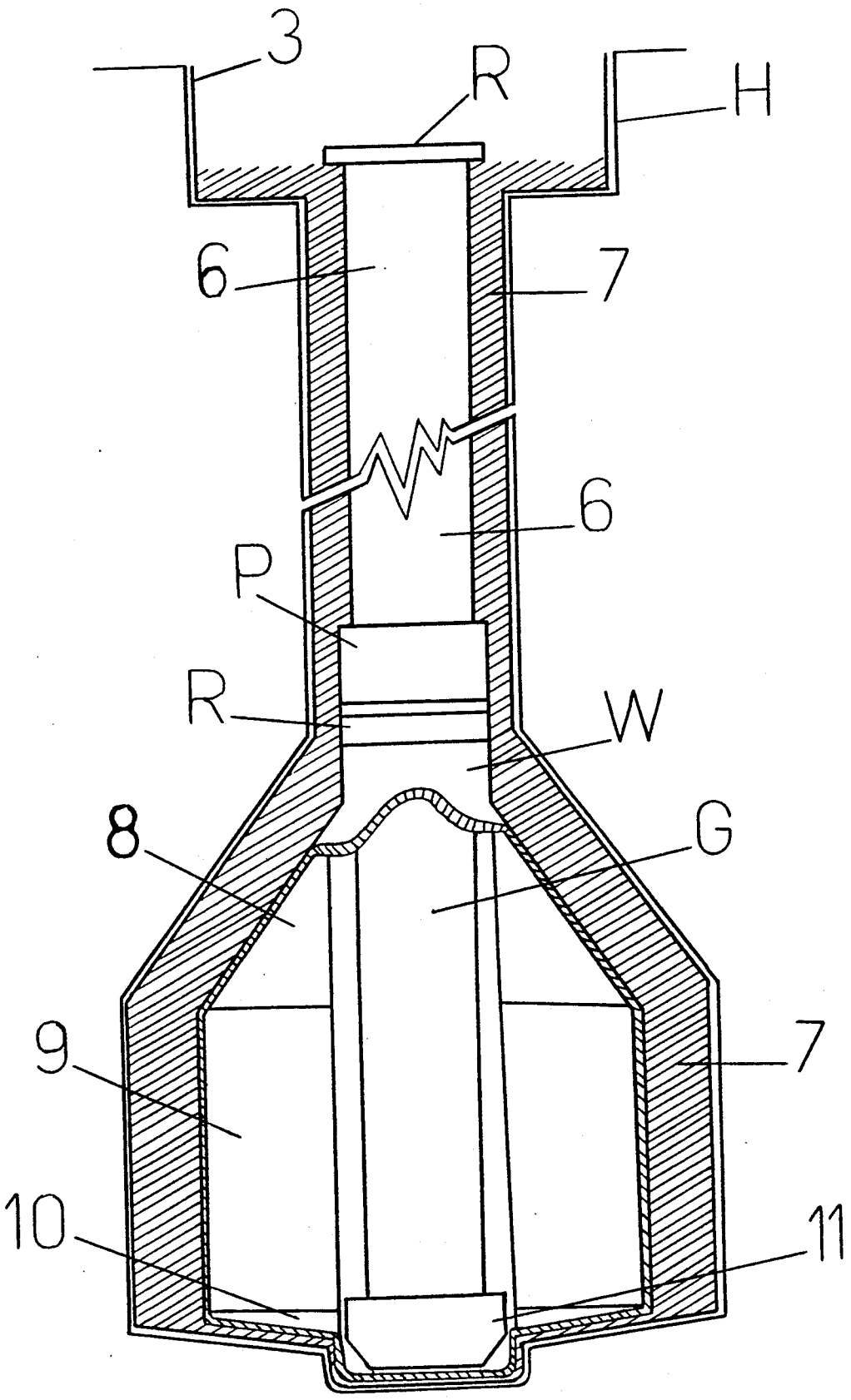
FIG. 12 shows the completed base system.

FIG. 12 shows the completed process illustrated. The inner and outer casings have been removed so the top of the pile may be prepared for the required attachment as specified by the building requirements. The system is at the bottom of the hole with the expanding foot fully expanded. The concrete has been pumped down the pipe and out the expanding foot to encase the system and pipe all the way to the top of the hole.

We claim:

1. An expanding base foundation system comprising;

a) a shaft made from a plurality of sections for placing inside a prepared hole in the earth;

b) base means on the lower end of said shaft and expandable outwardly by cam means cooperating between the shaft and the base means;

c) said shaft slidable through an opening of said expandable base for engaging the cam means and expanding said base;

d) valve means located in said shaft that use the sliding action to pump concrete through the shaft and the base;

e) plug means which are pushed down the shaft to assist the pumping action of the valve means;

f) bag means surrounding the shaft for preventing contamination to concrete which is to be placed around the outside of said shaft and for reducing shear loading by the earth on a pile formed by the concrete;

g) an inner casing which supports and centers the shaft in said hole and feeds the bag means into the prepared hole;

h) an outer casing located at the upper end of said prepared hole and which supports the bag and the inner casing; and i) slip ring seals between sections of the shaft which use the sliding action of the shaft to expand and contract said seal means to create a pumping action of concrete up along the out side of the shaft to form a pile.

* * * * *